United States Patent [19]

Mills

[11] 4,361,077

[45] Nov. 30, 1982

[54] VARIABLE POSITIVE DISPLACEMENT FLUID MOTOR/PUMP APPARATUS

[75] Inventor: Ned D. Mills, West Richland, Wash.

[73] Assignee: Varitan, Inc., Richland, Wash.

[21] Appl. No.: 160,013

[22] Filed: Jun. 16, 1980

[51] Int. Cl.[3] ..... F01B 13/04; F01B 3/00

[52] U.S. Cl. ..... 91/500; 91/504

[58] Field of Search ..... 91/499, 500, 501, 504–507

[56] References Cited

U.S. PATENT DOCUMENTS

| | | | |
|---|---|---|---|
| 2,430,753 | 11/1947 | Ziska | 91/505 |
| 3,291,068 | 12/1966 | Wiggermann | 91/505 |
| 3,434,429 | 3/1969 | Goodwin | 91/499 |

FOREIGN PATENT DOCUMENTS

| | | | |
|---|---|---|---|
| 2240714 | 3/1973 | Fed. Rep. of Germany | 91/506 |
| 2,801,95 | 7/1979 | Fed. Rep. of Germany | 91/505 |

*Primary Examiner*—William L. Freeh

*Attorney, Agent, or Firm*—Wells, St. John & Roberts

[57] ABSTRACT

A variable displacement hydraulic motor/pump apparatus 10 of the axial piston type is described that is more efficient over a wider range of speeds than previous devices. The apparatus 10 includes a main shaft 17 having a piston rod carrier 30 extending radially outward from the shaft for supporting a plurality of radially and angularly spaced piston rods 37. The piston rods 37 are double ended and held axially stationary with respect to the main shaft. Pistons 51 and 52 are mounted at the ends of the piston rods 37. Annular cylindrical barrels 60, 61 are supported by barrel carrier assemblies 84, 85 respectively circumferentially about the main shaft. Torque is transmitted between annular cylinder barrels 60, 61 and the main shaft 17 by the carrier 30. The barrels have piston cavities 65 formed therein for receiving corresponding pistons 51, 52. The barrel carrier assemblies 84 and 85 are supported by trunnion elements 94 and 95 for enabling the carrier assemblies 84 and 85 to pivot about tilt axes 97 to vary the angular orientation and volumetric displacement of the barrel cavities 65 with respect to the pistons 51, 52. The apparatus may be operated as a motor, as a pump, or as a combination pump and motor.

20 Claims, 7 Drawing Figures

VARIABLE POSITIVE DISPLACEMENT FLUID MOTOR/PUMP APPARATUS

TECHNICAL FIELD

This invention relates to variable displacement fluid motor/pump apparatus and more particularly to those of the axial piston type.

BACKGROUND OF THE INVENTION

Axial piston type variable displacement fluid motor/-pump units have been in existence for many years. However, they have been confined to rather limited application because of one or more design limitations. The prior art axial piston variable displacement fluid motor/pump units have generally been limited by one or more of the following design limitations: inefficiency of operation at low speeds particularly below 500 revolutions per minute; the generation of unacceptable levels of noise; highly susceptable to particle contamination in the fluid; inability to operate efficiently at high speeds; inability to operate efficiently over a very wide range of speeds; large axial forces requiring the use of expensive or multiple thrust bearings; the high weight to pumping displacement ratio; the substantial cost with respect to the amount of pumping displacement; the inordinant amount of rotating mass requiring large bearings and shafts; and limited operational life before major repairs are required.

Small particles in the neighborhood of 10 to 20 microns have been known to cause premature mechanical failures because of the excessively large mechanical loads between the traditional piston shoe, wear plate, valve ports and wear plate interfaces.

The principal objective of the present application is to overcome many, if not all, of the previous design limitations. A further objective is to provide such a unit that can operate efficiently over a wide range of speeds.

The present invention provides for higher efficiencies of the apparatus over a wider range of speeds including continuously variable speeds at any desired flow rate with a substantial increase in operation between maintenance periods. Furthermore, the present invention provides a system for equalizing forces within the unit to reduce the numbers and size of bearings and shafts which in turn substantially reduces the weight to displacement ratio. Additionally, the present invention greatly increases the variety of applications and alternative modes of operation from a single mechanical device.

These and other objects and advantages of this invention will become apparent upon reading the following detailed description of a preferred embodiment.

BRIEF DESCRIPTION OF THE DRAWINGS

The preferred embodiment of this invention is illustrated in the accompanying drawings, in which.

DETAILED DESCRIPTION OF A PREFERRED EMBODIMENT

Figure 1:
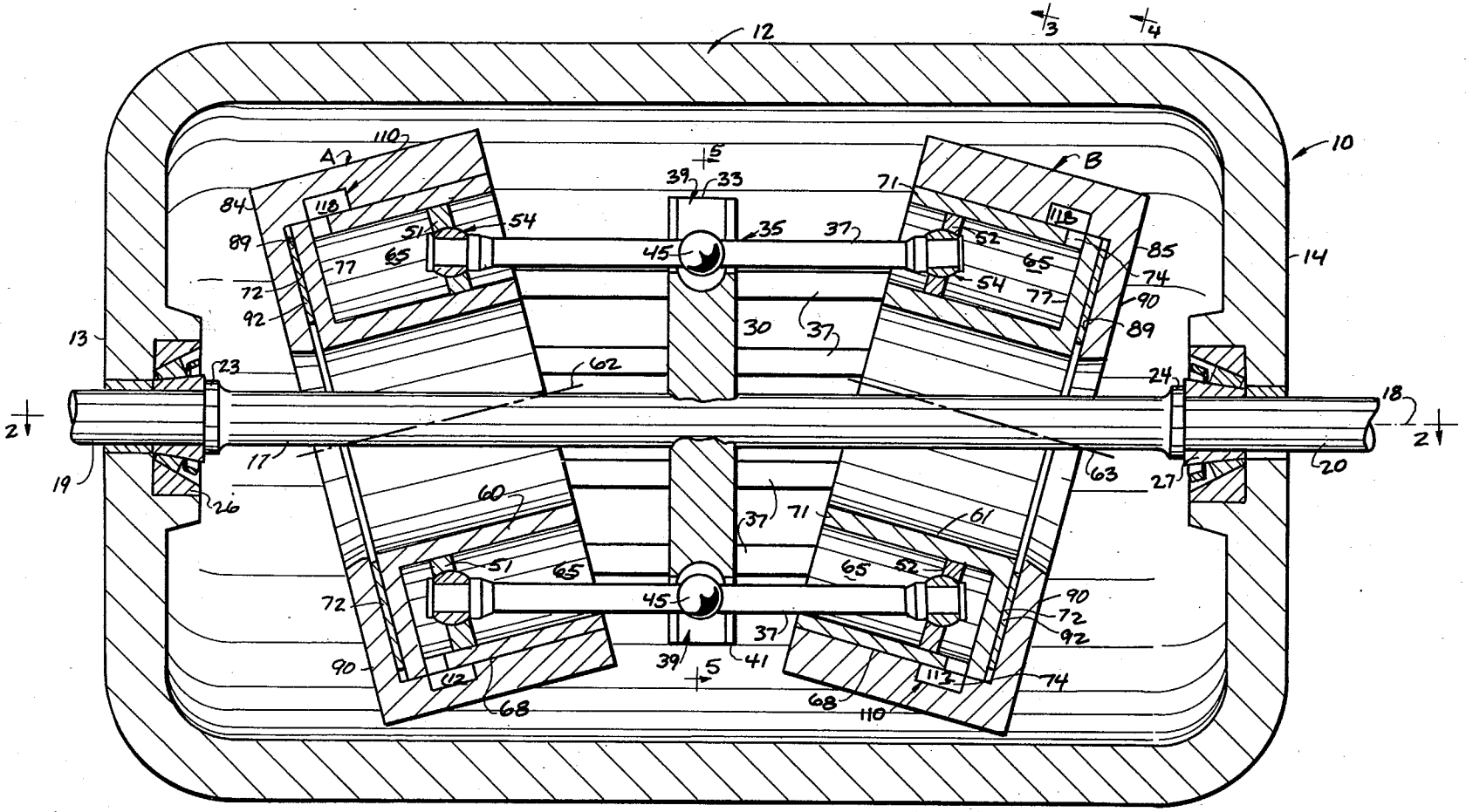
FIG. 1 is a schematic longitudinal cross-sectional view along a main axis of the apparatus illustrating a plurality of axially oriented double ended piston rods communicating with opposed tiltable annular cylinder barrels.
Figure 2:
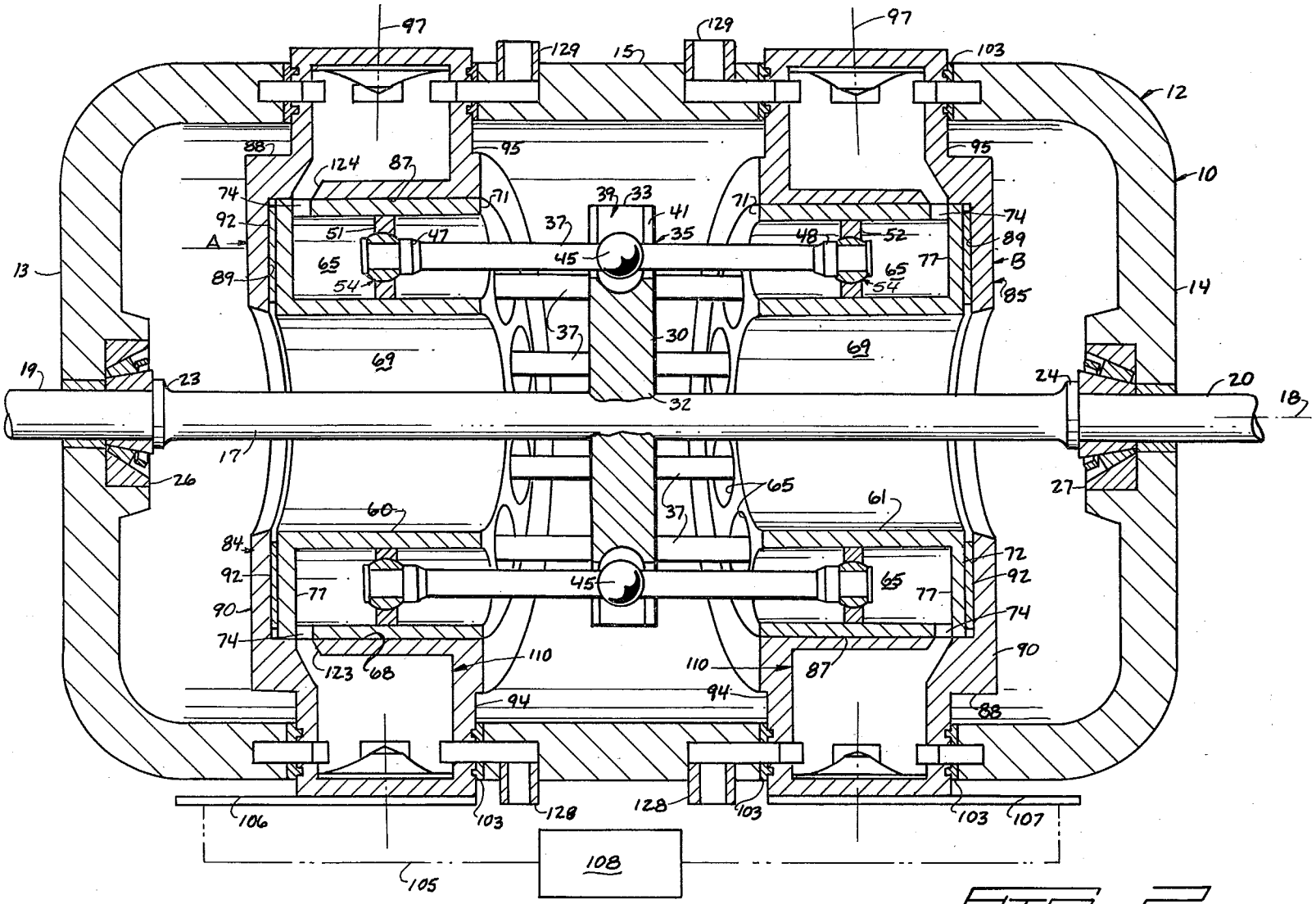
FIG. 2 is a schematic longitudinal cross-sectional view taken along line 2—2 in FIG. 1.

Referring now in detail to the drawings, there is illustrated in FIG. 1 a variable displacement fluid motor/-pump apparatus generally designated with the numeral 10 having a housing 12 enclosing internal components of the apparatus. The housing 12 has ends 13, 14 with a central cylindrical housing wall 15 (FIG. 2). The apparatus 10 is suitable for use with compressible fluids as well as noncompressible fluids. For purpose of example, the apparatus 10 will be described in terms of hydraulic fluid, since most applications will involve noncompressible fluids.

The fluid motor/pump apparatus 10 includes a main shaft 17 that extends between ends 19 and 20 that are supported by thrust bearings 26 and 27 for rotation about a main axis 18. The shaft ends 19 and 20 have shoulders 23 and 24 formed thereon for engaging the thrust bearings. In the configuration illustrated in FIGS. 1 and 2, the coaxial ends 19 and 20 extend through the housing ends 13 and 14 for connection to other drive systems.

The apparatus 10 further includes a torque transfer means illustrated as a piston rod carrier or wheel 30 that is affixed or mounted on the main shaft 17 intermediate the ends 19 and 20. The carrier 30 performs a function similar to that of a sprocket for transferring torque between a shaft and a peripheral drive element. The carrier 30 includes an inner hub 32 affixing the carrier 30 to the main shaft 17 so that the carrier 30 revolves coincident with the angular displacement of the shaft 17. The carrier 30 includes an outer periphery 33. The apparatus 10 includes piston rod support means 35 adjacent the outer periphery 33 of the carrier 30 for supporting a plurality of double ended piston rods 37 in a substantially axial orientation with respect to the main axis 18. The piston rod support means 35 supports the double ended piston rods 37 radially spaced from the main shaft axis and at angularly spaced positions about the main shaft axis. Preferably, the piston rods 37 are evenly angularly spaced about the main shaft axis 18.

The piston rod support means 35 includes a restrictive guide means 39 operatively interconnecting the double ended piston rods 37 with the carrier 30 to enable the piston rods 37 to move radially inward and outward with respect to the main axis of the shaft 17 but to prevent the double ended piston rods 37 from moving axially with respect to the main shaft 17. The guide means 39 permits a small degree of precessional circumferential movement to accommodate elliptical movement of the piston rods 37 about the main axis 18 as the shaft 17 rotates.

Figure 6:
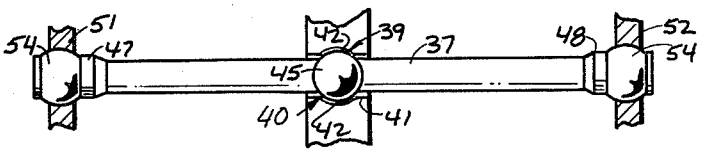
FIG. 6 is a side view illustrated along lines 6—6 in FIG. 5.

The restrictive guide means 39 preferably includes a ball and socket arrangement 40 (FIG. 6) that includes socket slots 41 formed radially in the outer periphery 33 having cylindrical surfaces 42 (FIG. 6). The ball and sprocket arrangement includes an enlarged ball portion 45 that is formed as part of the double ended piston rods 37 intermediate piston rod ends 47 and 48. The enlarged ball section 45 slides along the cylindrical surfaces 42 to enable the piston rods 37 to move radially and slightly circumferentially with respect to the main axis as the main shaft 17 rotates. Additionally, the piston rods 37 may pivot about the ball 45 to accommodate varying orientation of the piston rods. However, the cylindrical surfaces prevent the double ended piston rods 37 from moving axially. Other types of restrictive guide means 39 may be utilized other than the ball and socket arrangement 40 to enable the piston rods 37 to move radially and slightly circumferentially with respect to the main shaft 17 but not axially.

Pistons 51 and 52 are mounted at opposite ends 47 and 48 respectively of each double ended piston rod 37. The piston rod ends 47 and 48 are operably connected to the pistons 51 and 52 through pivotal connections 54 to enable the pistons 51 to be angularly displaced with respect to the axes of the piston rods 37.

The apparatus 10 further includes two annular cylinder barrels 60 and 61 that are symmetrical about respective barrel axes 62 and 63. Each of the annular cylindrical barrels 60, 61 have a plurality of piston cavities 65 formed therein in an axial direction with respect to barrel axes 62, 63. The cavities 65 extend inward from an annular face wall 71 toward an annular end bearing wall 72. Each annular cylinder barrel 60, 61 includes an outer annular wall 68 and an inner annular wall 69. The number of piston cavities in each annular cylindrical barrel 60, 61 corresponds to the number of double ended piston rods 37 with a piston 51 or 52 positioned within each piston cavity 65.

Figure 4:
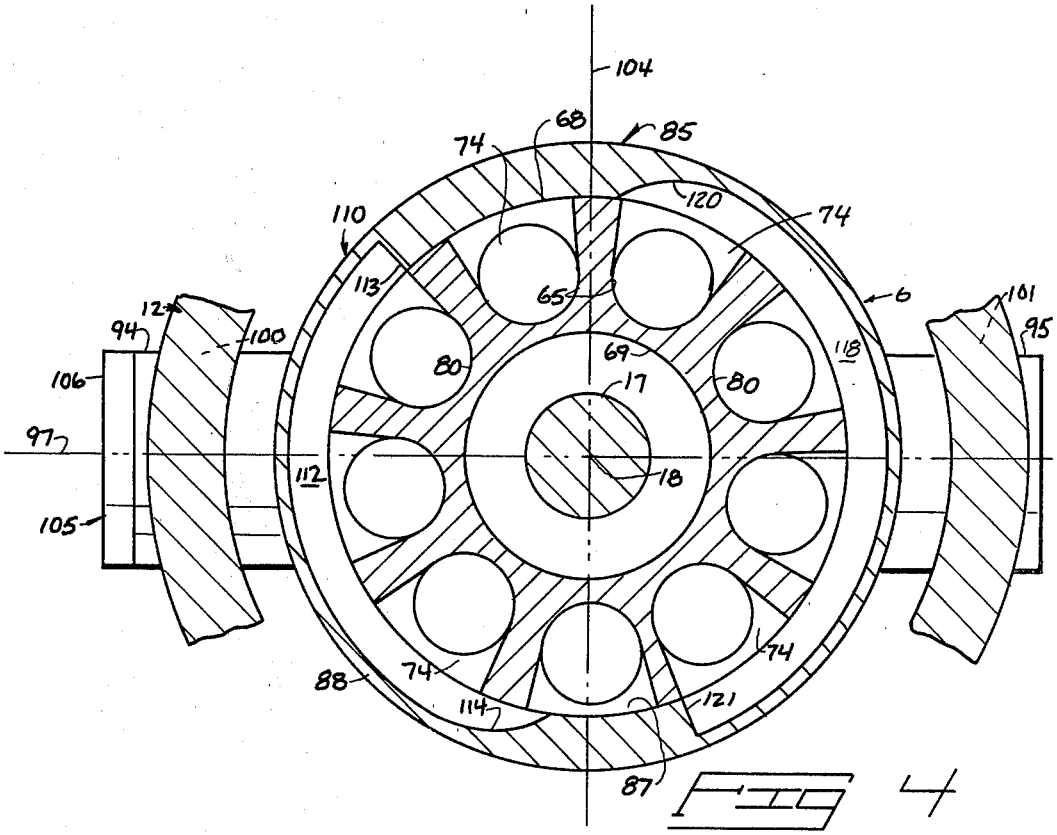
FIG. 4 is a cross-sectional view taken along line 4—4 in FIG. 1.
Figure 5:
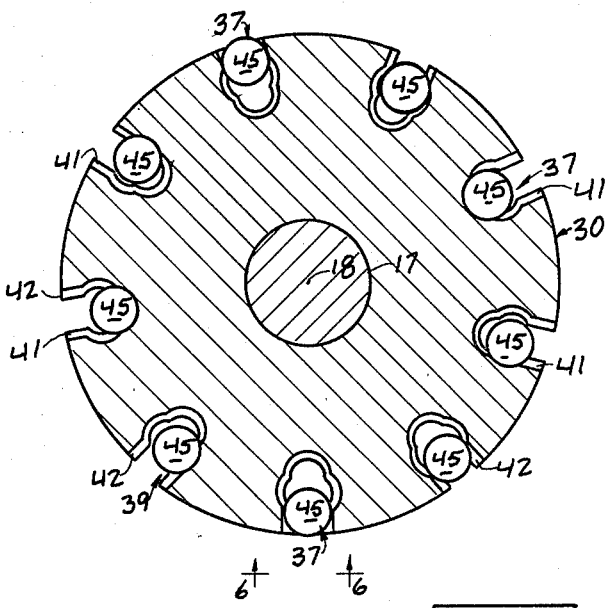
FIG. 5 is a cross-sectional view taken along line 5—5 in FIG. 1.

Each annular cylinder barrel 60, 61 includes a fluid port 74 extending from the piston cavity 65 to the outer annular wall 68 as illustrated in detail in FIG. 4. The fluid port has a wide port opening in the outer annular wall 68. Each of the piston cavities 65 includes an enclosed end 77 adjacent the annular end bearing wall 72. Each of the piston cavities 65 includes a cylindrical wall 80 for sliding along the axially stationary pistons 51, 52.

The apparatus 10 further includes annular barrel carrier assemblies 84 and 85 for supporting the annular cylindrical barrels 60 and 61 at axially spaced locations along the main axis and centered about the main shaft axis 18. Each of the assemblies 84 and 85 are formed in a cup-shaped configuration having an inner annular side wall 87 and an outer side wall 88. The side wall 87 forms a bearing surface that is complementary to the outer annular wall 68 of the barrels 60, 61. Each of the assemblies 84, 85 includes an inner end wall 89 for receiving the annular end bearing wall 72. Each assembly 85 further includes an outer end wall 90. A bearing means 92, such as a high density, low friction plastic disc, is interposed between the surfaces 72 and 89 to permit the barrels 60, 61 to easily rotate within the carrier assemblies 84, 85.

Figure 3:
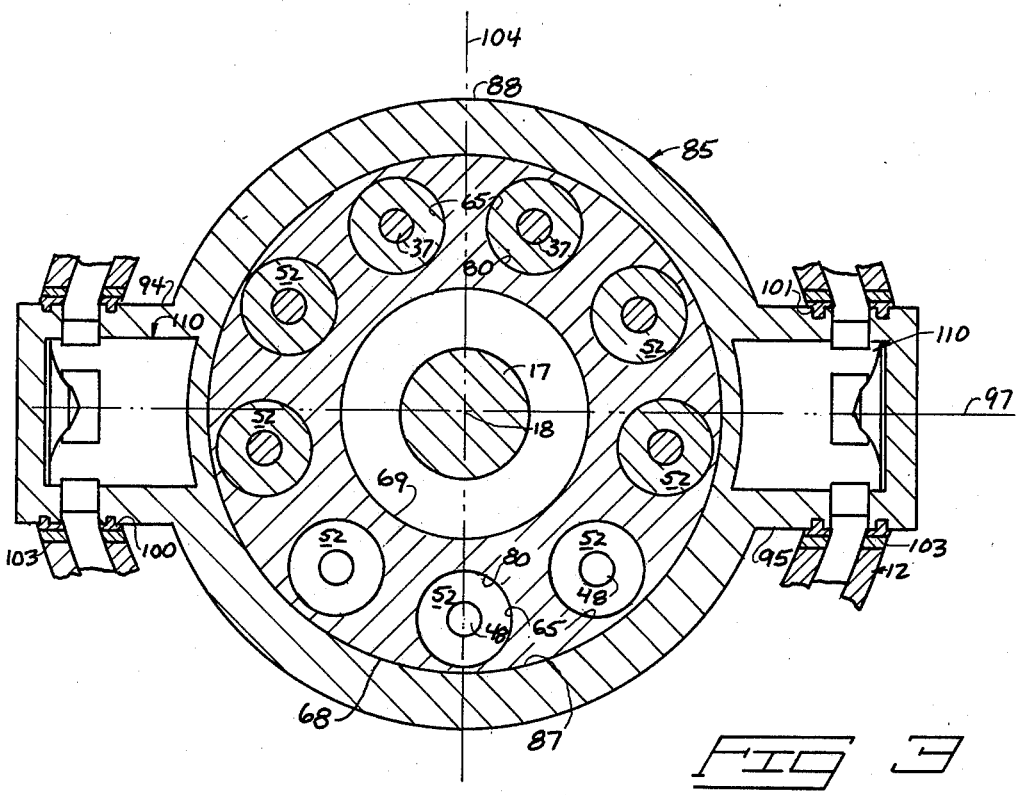
FIG. 3 is a transverse cross-sectional view taken along line 3—3 in FIG. 1.

Each assembly 84, 85 further includes barrel tilting means in the form of trunnion elements 94 and 95 that are diammetrically opposed to each other and extend outward from the outer side wall 88 and extend through the housing wall 15 as illustrated in FIGS. 2 and 3. The trunnion elements 94 and 95 support the assemblies 84 and 85 so that the assemblies 84 and 85 are unable to either rotate about or move axially with respect to the main axis 18. However, the trunnion elements permit the assemblies 84 and 85 to be tilted about tilt axes 97 in which the tilt axes intersect and are perpendicular to the main axis of the main shaft 17 with the tilt axes intersecting corresponding barrels 60, 61 as illustrated in FIGS. 2–4. The trunnion elements 94 and 95 extend through bearing openings 100 and 101 respectively formed in the housing wall 15. The bearing openings 100 and 101 have bearing means 103 formed therein to enable the trunnion elements to be readily rotated about the tilt axis 97 to tilt the annular barrel carrier assemblies 84 and 85 with respect to the tilt axes 97. The trunnion elements 94 and 95 support the annular barrel carrier assemblies 84 and 85 centered with respect to the main shaft 17 so that the barrel axes 62 and 63 cointersect with the tilt axis 97 and the main axis of the main shaft 17 at the axially spaced locations to tilt the barrels about the tilt axes with respect to the main axis 18. Preferably the barrel axes 62 and 63 lie in a common axial plane 104 (FIGS. 3 and 4) with the main axis 18. The tilt axes 97 are preferably perpendicular to the plane 104 and lie in transverse planes containing the piston pivot axes as illustrated in FIG. 1.

Figure 7:
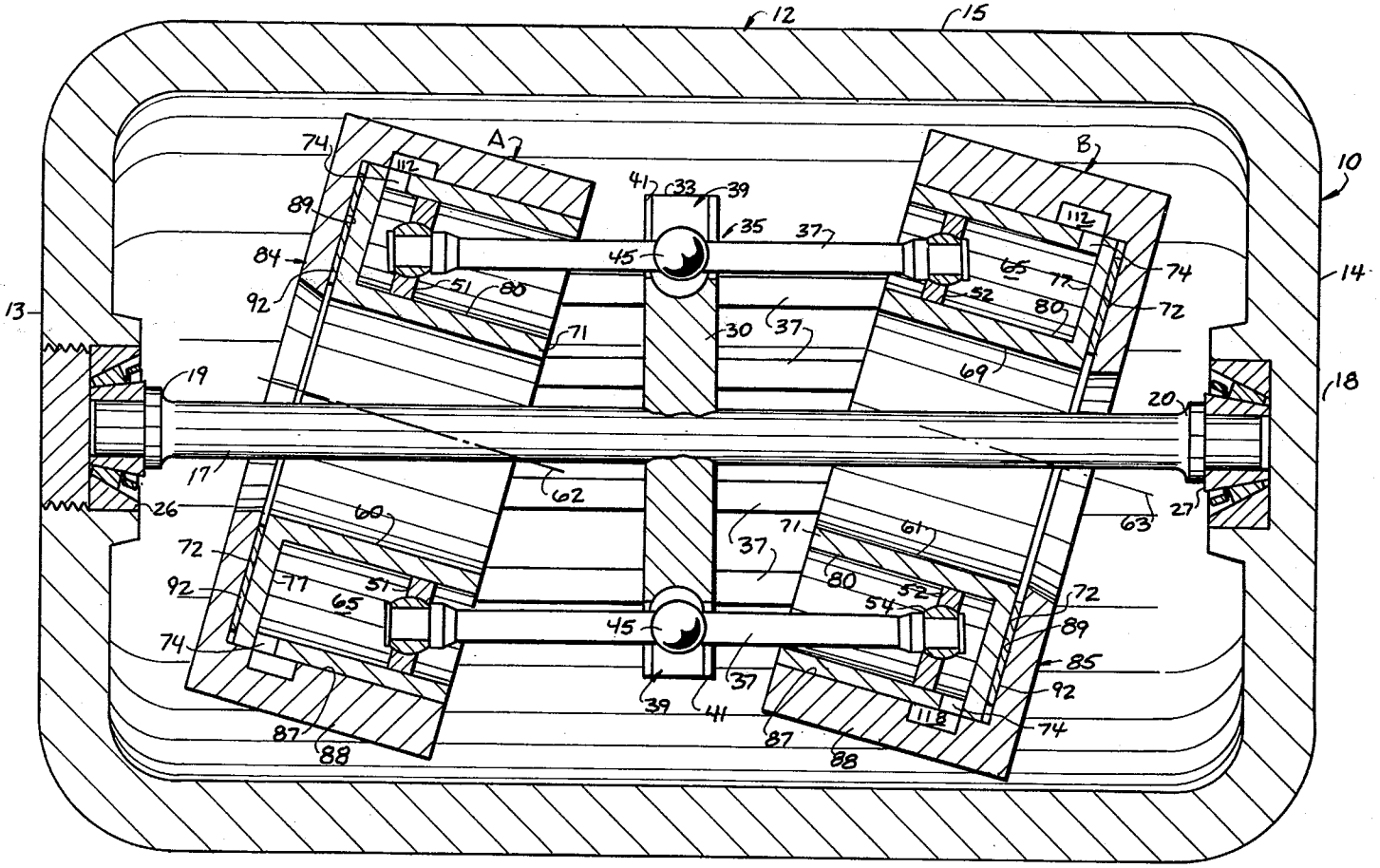
FIG. 7 is a schematic longitudinal cross-sectional view along the main axis similar to FIG. 1 except showing alternate features.

The apparatus 10 further includes means 105 (FIG. 2) operatively connected to the trunnion elements 94, 95 for pivoting one or more of the trunnion elements 94 and 95 to pivot the annular barrel carrier assemblies 84 and 85 either independently or in coordination with each other to tilt the barrels 60, 61 to varying angular orientations with respect to the main axis 18. For many applications it is desirable to pivot the annular barrel carrier assemblies 84 and 85 in unison so that both barrels 60 and 61 are at the same tilt angle with respect to the main axis. FIG. 1 shows the barrels 60 and 61 at a V-shaped equal angular configuration. However, FIG. 7 shows barrel 60 tilted to an angular orientation with respect to axis 18 substantially parallel with barrel 61. However, for other applications it may be desirable to angularly orient one barrel 60 or 61 at a different angle with respect to the main axis 18 depending upon the application and environment of use.

For illustrative purposes, the means 105 includes levers 106 and 107 that are connected to trunnion elements 94 for tilting the respective barrels 60, 61 about their respective intersecting tilt axes 97. In most applications, a control mechanism 108 (shown in block diagram form) is operatively connected to the levers 106 and 107 to either operate the levers 106 and 107 in coordination with each other or independently of each other depending upon the application. A wide variety of various controlled mechanisms 108, either mechanical or hydraulic or electrical, may be utilized for accomplishing the tilting operation of barrels 60, 61 to vary the volumetric fluid displacement and fluid flow of the apparatus to provide a continuously variable displacement hydraulic motor/pump apparatus.

Each of the annular barrel carrier assemblies 84 and 85 includes a passageway 110 (FIGS. 2–4) therethrough selectively communicating with the fluid ports 74 of the annular cylinder barrels 60, 61 for enabling hydraulic fluid to pass to and from the piston cavities 65. The passageway 110 includes a high pressure manifold cavity 112 (FIG. 4) formed in the barrel carrier assembly 84, 85 on one side of the plane 104 as illustrated in FIG. 4. The high pressure manifold cavity 112 extends angularly about a segment of the carrier assemblies on both sides of the tilt axes 97 terminating at ends 113 and 114. In a preferred embodiment, the high pressure manifold cavity 112 extends approximately 54° to both sides of the tilt axis 97.

The passageway 110 further includes a low pressure manifold cavity 118 formed in the barrel carrier assemblies 84, 85 on the opposite side of the plane 104 and substantially diammetrically opposed from the high pressure manifold cavity 112. The manifold cavity 118 extends angularly about a segment of the carrier assemblies on both sides of the tilt axis 97 terminating at ends 120 and 121. In a preferred embodiment, the low pressure manifold cavity extends approximately 67° to both sides of the tilt axis 97. The manifold cavities 112 and 118 selectively communicate with the fluid ports 74 to permit fluid to flow into and out of the piston cavities 65. The direction of flow between manifold cavities 112 and 118 depend upon whether or not the apparatus 10 is operating as a pump or operating as a motor. When the apparatus 10 is operating as a motor, the fluid direction is from the high pressure manifold cavity 112 to the low pressure manifold cavity 118. When the apparatus is operating as a pump, the fluid flow is from the low pressure manifold cavity 118 to the high pressure manifold cavity 112. For purposes of illustration, the portion of the apparatus including the barrel 60 and the carrier assembly 84 will be referred to as Unit A and the portion of the apparatus including barrel 61 and carrier assembly 85 will be referred to as Unit B.

The passageway 110 further includes flow channels 123, 124 (FIG. 2) that extend from the high and low pressure manifold cavities 112 and 118 respectively and through the interior of the barrel carrier assemblies 84, 85 and through the trunnion elements 94, 95 to hydraulic fluid fixture elements 128, 129 respectively. The hydraulic fluid fixture 128 communicates with the high pressure manifold cavity 112 and may be referred to as the high pressure hydraulic connection fixture and the hydraulic fluid fixture 129 communicates with the low pressure manifold cavity 118 and may be referred to as the low pressure hydraulic connecting fixture.

The apparatus 10 is extremely versatile and may be utilized in many various configurations. For example, an apparatus may be operated as a pump in which both Units A and B are set at equal angles in a V configuration as illustrated in FIG. 1 in which the barrels 60, 61 are driven by the main shaft 17. As the shaft 17 rotates, the piston rods 37 rotate about the main axis 17 in the elliptical path causing the barrels 60, 61 to rotate in unison in elliptical paths with respect to the main axis 18. As the barrels 60, 61 rotate as illustrated in FIGS. 3 and 4, hydraulic fluid is progressively drawn in through the low pressure manifold cavity 118 and delivered to the fluid ports 74 as the volume between the pistons 51, 52 and wall 77 expands. As the piston rods pass through the lower portion of the plane 104 as viewed in FIG. 4, the fluid is transferred to the high pressure manifold cavity 112 where it is progressively compressed as the barrel carrier assemblies 84, 85 move axially to compress the fluid between the pistons 51, 52 and the piston cavity walls 77. The fluid is permitted to exit from the high pressure manifold 112 out through the high pressure hydraulic fluid fixture 128. The high pressure fluid from the high pressure fixture 128 may be directed to separate receiving systems or the outputs from the Units A and B may be interconnected to provide a single outflow from the apparatus.

It should be noted that equal and opposite pressure is exerted on the respective ends of the piston rods 37 so that very little if any resultant axial force is exerted on the shaft 17. Consequently, the shaft 17 and the thrust bearings 26 and 27 may be considerably smaller than previous prior art axial piston variable displacement units.

The apparatus 10 may be operated with both of the Units A and B at equal angles as illustrated in FIG. 1 with substantially the same displacement output from each Unit A and B. Or one of the barrels 60, 61 may be tilted at a different angle to provide for differential flow patterns. Additionally, it should be noted that either barrel 60, 61 may be tilted to an overcenter arrangement to rapidly reverse the flow from such unit as illustrated in schematic sketch 7. In schematic sketch 7, barrels 60, 61 are placed in a parallel orientation so that fluid is flowing in one direction through Unit A and in an opposite direction through Unit B. It should be also noted that the axial forces on the units are counterbalanced so that the axial thrust forces on shaft 17 approach zero even though bending forces are exerted upon the shaft 17 in the configuration shown in FIG. 7.

The shaft 17 may be double ended as illustrated in FIG. 1 having an input/output capability at both ends, or the shaft may have a single output/input connection depending upon the desired application. It should be noted that the axial forces on the piston rods are counterbalanced so that very small axial forces are exerted on the shaft 17. The angular orientation of the units A and B may be readily adjusted by control mechanism 108 either in coordination or independently of each other to rapidly and quickly reverse fluid flows, rapidly and efficiently adjust the speed of the shaft 17 and rapidly and efficiently vary the fluid displacement from the Units A and B. The apparatus 10 provides a continuously variable displacement hydraulic fluid pump/motor apparatus that has a wide range of applications.

A further application is illustrated in FIG. 7 in which the shaft 17 does not extend through either end 13 and 14 but that one of the Units A or B operates as a motor in which a high pressure fluid is applied to the high pressure manifold cavity 112 to generate a torque on the main shaft 17 which is transmitted through the piston rod support means 35 to rotate the piston rods 37 about the shaft axis 18 to cause fluid to be pumped from the other Unit A or B.

Consequently the system may be utilized totally as a pump, or totally as a motor, or as a combination motor and pump in which one of the elements A or B serves as the motor and the other element B or A serves as the pump. The torque of the motor unit may be adjusted by the angular orientation of the motor unit and the fluid displacement may be varied by the angular orientation of the pump element.

It should be also noted that a relatively small amount of mass is being rotated which enables the unit to be built in a very compact housing having a very high torque to weight ratio and a high displacement to weight ratio which results in considerable savings. Furthermore, the unit is considerably less sensitive to hydraulic contamination than other axial pump elements since the forces are considerably reduced.

In the preferred embodiment above described, the torque transfer means utilizes the piston rod carrier 30 to indirectly connect the rotating barrels 60 and 61 and the main shaft 17 for transferring torque between the shaft and the rotation barrels 60 and 61. Other embodiments may include more direct connections between the rotating barrels 60 and 61 and the main shaft 17 with or without the piston rod carrier 30. In such cases, restrictive guide means 39 may be mounted to the housing for preventing axial movement of the piston rods.

It should be understood that the above described embodiments are simply illustrative of various alternatives and numerous other alternatives and variations and embodiments may be readily devised by those skilled in the art without deviating from the principal of the invention. Only the following claims are intended to limit and define the invention.

What is claimed is:

1. A positive displacement fluid motor/pump apparatus, comprising:

a main housing;

a main shaft rotatably mounted within the main housing for rotation about a main axis;

two opposing annular cylinder barrels encircling the main shaft at axially spaced locations along the main axis;

each of the annular cylinder barrels having a plurality of corresponding piston cavities formed therein with each piston cavity having a fluid port communicating therewith to permit flow of fluid to and from the piston cavity;

a plurality of piston rod assemblies extending axially in opposite directions along the main shaft between the axially spaced annular cylinder barrels at angularly and radially spaced locations about the main axis;

each piston rod assembly having a piston at an end thereof projecting into a corresponding piston cavity;

means for maintaining the pistons axially stationary with respect to the main axis;

two opposing barrel carrier assemblies mounted within the main housing for receiving and rotatably supporting corresponding annular cylinder barrels at the axially spaced locations along the main shaft to enable the annular cylinder barrels to rotate in annular paths coaxially about barrel axes that intersect the main axis at the axially spaced locations along the main axis with the barrel axes and the main axis lying in a common axial plane;

said annular barrel carrier assemblies having fluid passageway means formed therein for communicating with the fluid ports of the piston cavities to permit fluid to flow through the fluid passageway means and fluid ports to and from the piston cavities;

said annular barrel carrier assemblies having barrel tilting means for stationarily supporting the annular barrel carrier assemblies to prevent their rotation about the main axis and for enabling the annular barrel carrier assemblies to tilt the opposing barrels about tilt axes that transversely intersect the barrels and countersect the main axis and the barrel axis at the axially spaced locations along the main axis to cause the barrels to rotate in varying elliptical orbital paths centered with respect to the main axis to vary the axial movement of the piston cavities with respect to the axially stationary pistons as the main shaft rotates to vary the amount of fluid flowing to and from the piston cavities; and torque transfer means operatively interconnecting the cylinder barrels and the main shaft for transmitting rotation therebetween to provide a positive displacement fluid motor/pump apparatus.

2. The fluid pump/motor apparatus as defined in claim 1 wherein the barrel tilting means are adapted to tilt the annular barrel carrier assemblies in unison to vary the angular displacement of the barrel axes to opposite sides of the main axis to reverse the directions of the flow of the fluid to and from the piston cavities.

3. The fluid pump/motor apparatus as defined in claim 1 further comprising control means operatively connected to at least one of the annular barrel carrier assemblies for pivoting the annular barrel carrier assembly about the tilt axis to vary the amount of fluid flowing to and from the piston cavities and to vary the direction of flow of the fluid through the fluid passageways.

4. The fluid pump/motor apparatus as defined in claim 1 wherein the main shaft extends in both directions beyond the cylinder barrels and is supported within the housing by bearings adjacent each end of the shaft with no bearing support intermediate said ends.

5. The fluid pump/motor apparatus as defined in claim 1 wherein the main shaft has at least one end that extends through the housing for connection to drive shafts.

6. The fluid pump/motor apparatus as defined in claim 1 wherein the torque transfer means includes a radial wheel extending between the main shaft and the piston rod assemblies for transferring torque therebetween.

7. The fluid pump/motor apparatus as defined in claim 1 further comprising control means operatively independently connected to the annular barrel carrier assemblies for independently pivoting the assemblies about their tilt axis to differentially vary the fluid flow to and from the corresponding piston cavities.

8. The fluid pump/motor apparatus as defined in claim 1 wherein said means for maintaining the pistons axially stationary additionally has provisions for permitting the piston rods to precess in elliptical paths while maintaining the pistons axially stationary as the annular cylinder barrels rotate about the main axis.

9. The fluid pump/motor apparatus as defined in claim 1 wherein the tilt axes intersect the main axis in alignment with the pistons to maintain the piston rods elliptically concentric to the main axis as the annular cylinder barrels are pivoted about the tilt axes.

10. The fluid pump/motor as defined in claim 1 wherein the fluid passageways include an input fluid manifold on one side of the common plane and an output fluid manifold on the opposite side of the common plane for sequentially communicating with piston cavity ports as the annular cylinder barrel rotates with respect to the supporting annular barrel carrier assembly.

11. The fluid pump/motor apparatus as defined in claim 3 wherein the fluid passageways further include fluid entrance and fluid exit channels communicating with the fluid manifolds and extending through the barrel tilting means to enable fluid to flow to and from the fluid manifolds.

12. The fluid pump/motor apparatus as defined in claim 1 wherein each annular cylinder barrel has an outer annular side bearing wall, an inner side non-bearing wall and an outer end bearing wall and wherein each annular barrel carrier assembly has a cup shaped housing with an inner annular side bearing wall for receiving the outer annular side bearing wall of the barrel and an inner end bearing wall for receiving the other end bearing wall of the barrel to support the annular cylinder barrel therein with the inner side non-bearing wall of the annular cylinder barrel exposed to the main shaft.

13. The fluid pump/motor apparatus as defined in claim 12 wherein each annular barrel carrier assembly has bearing means interposed between the outer end bearing wall of the barrel and the inner end bearing wall of the annular barrel carrier assembly to enable the annular cylinder barrel to freely rotate with respect to the supporting annular barrel support.

14. The fluid pump/motor apparatus as defined in claim 1 wherein the means for maintaining the pistons axially stationary includes restrictive guide means for enabling the piston rod assemblies to move radially with respect to the main axis and for preventing the piston rods from moving axially with respect to the main axis.

15. The fluid pump/motor apparatus as defined in claim 14 wherein the restrictive guide permits the piston rods to pivot about intermediate axes transverse to the main axis to enable one end of such a piston rod assembly to move radially outward from the main axis and the other end of each piston rod assembly to move radially inward toward the main axis when one of the annular cylinder barrels is tilted about its respective tilt axis.

16. The fluid pump/motor apparatus as defined in claim 14 wherein the restrictive means permits the piston rod assemblies to precess circumferentially a limited distance with respect to the main shaft to accommodate the elliptical movement of the pistons as the cylinder barrels are rotated about the main axis.

17. The fluid pump/motor apparatus as defined in claim 14 wherein each piston rod assembly has an abutment means and wherein the restrictive guide includes radially extending slot means defining shoulder means with the radially extending slot means receiving intermediate sections of the piston rods to enable the piston rod assemblies to move radially within the slot means with respect to the main axis with the abutment means engaging the shoulder means to prevent axial movement.

18. The fluid pump/motor apparatus as defined in claim 17 wherein each abutment means includes a spherical shaped enlargement intermediate the ends of the piston rod assembly and wherein the slot means includes cylindrical surfaces extending radially from the main axis for receiving the spherical shaped enlargement to enable the piston rods to slide radially with respect to the main axis and to prevent axial movement of the piston rods with respect to the main axis.

19. The fluid pump/motor apparatus as defined in claim 1 wherein each piston has a pivotal connection with a corresponding piston rod to enable each piston to pivot with respect to the corresponding piston rod as the corresponding cylinder barrel is tilted about the corresponding tilt axis and wherein the tilt axes lie in transverse planes that extend through the piston pivot connections.

20. The fluid pump/motor apparatus as defined in claim 19 further comprising control means operatively connected to the annular barrel carrier assemblies for uniformly tilting the assemblies about the respective tilt axis with the piston rods remaining parallel to and elliptically concentric with the main axis as the piston rods revolve about the main axis.

* * * * *